United States Patent [19]

Katsuta et al.

[11] Patent Number: 4,890,533

[45] Date of Patent: Jan. 2, 1990

[54] KEY DEVICE FOR ELECTRONIC KEYBOARD MUSICAL INSTRUMENT

[75] Inventors: Masanori Katsuta; Tsutomu Yamaguchi, both of Iwata; Yutaka Tamai; Norizo Kamimura, both of Hamamatsu, all of Japan

[73] Assignee: Kabushiki Kaisha Kawai Gakki Seisakusho, Shizuoka, Japan

[21] Appl. No.: 255,873

[22] Filed: Oct. 11, 1988

[30] Foreign Application Priority Data

Oct. 12, 1987 [JP] Japan ..... 62-154732[U]
Dec. 2, 1987 [JP] Japan ..... 62-182977[U]

[51] Int. Cl.[4] ..... G10C 3/12
[52] U.S. Cl. ..... 84/439
[58] Field of Search ..... 84/433, 439, 440

[56] References Cited

U.S. PATENT DOCUMENTS 4,217,803 8/1980 Dodds ..... 84/439
4,375,179 3/1983 Schwartz et al. ..... 84/439
4,667,563 5/1987 Wakuda et al. ..... 84/439

*Primary Examiner*—L. T. Hix
*Assistant Examiner*—Brian W. Brown
*Attorney, Agent, or Firm*—Michael N. Meller

[57] ABSTRACT

An improved key device for an electronic keyboard musical instrument of the type having a fulcrum and a chassis each mounted on a support, and having a key pivotably mounted on the fulcrum, is further provided with a rotor rotatably coupled to the chassis. A first end of the rotor is in contact with an after-fulcrum rear end of the key. A key-returning spring is arranged to couple the rotor and the chassis. A rotation shaft member is fastened to the chassis, the rotor having a recessed portion for receiving the rotation shaft member whereby the rotor is rotatable relative to the rotation shaft member. A heavy mass portion is fastened to a second end of the rotor, the first and second ends of the rotor being on opposite sides of a rotational center of the rotation shaft member. A stopper is mounted on the chassis for suppressing vibrations of the rotor generated when the key is depressed.

1 Claim, 5 Drawing Sheets

KEY DEVICE FOR ELECTRONIC KEYBOARD MUSICAL INSTRUMENT

FIELD OF THE INVENTION

This invention relates to a key device for an electronic keyboard musical instrument such as an electronic piano.

BACKGROUND OF THE INVENTION

Prior to the invention, a device was known which had a weight c attached to the upper side of an after-fulcrum rear end b of a key a, as shown in FIG. 9. This weight provided the key with return force. Another device was known which had one end of a U-shaped plate spring d fastened to the after-fulcrum rear end b of the key a and the other end of the U-shaped plate fastened to a chassis e as shown in FIG. 10, so as to provide a return force on the key a. Either of these prior art devices provides a key touch load versus key stroke characteristic similar to that of a piano key.

With such a conventional device as shown in FIG. 9 or FIG. 10, the static characteristics of the key a comprising the key stroke versus key touch load characteristic when the key a is slowly depressed and when the key a is slowly returned to its original position do not constitute a hysteresis characteristic as shown in FIG. 11, so that the key rises if the pressing force exerted by a finger is weakened even slightly as the key a is being further depressed. This aspect tends to cause shaky depressing of the key a and makes it difficult to achieve a delicate expression in a performance as done by a piano touch.

In the case of the conventional device shown in FIG. 9, the return force exerted on key a is derived only from the weight c, so that the mass of the keyboard as a whole is increased. If the mass of the weight c is decreased, the after-fulcrum portion of the key must be made longer in order to be well-balanced with the initial load of the key a, thus resulting in the disadvantage of a relatively larger-sized keyboard.

With the conventional device shown in FIG. 10, the touch load of the dynamic characteristic of the key a is small due to the small equivalent mass of the key a as shown in FIG. 11, which gives rise to the inconvenience that a player of the instrument cannot feel the reaction of the key as felt with a piano when striking a key. There is also another inconvenience that the plate spring has to be removed before the key a can be removed and that a skilled hand is necessary for detaching and attaching the plate spring.

SUMMARY OF THE INVENTION

It is the object of the present invention to eliminate the aforementioned disadvantages of the above-described conventional key devices.

To achieve the above object, the first aspect of the present invention provides a key device for an electronic keyboard musical instrument characterized in that a first end of a rotatable rotor whose recessed portion is fitted with a rotation shaft member fastened to a chassis is put in contact with an after-fulcrum rear end of a key and a key-returning spring couples the rotor to the chassis. The second aspect of the invention provides a key device wherein a heavy mass portion is provided on a second end of the rotor, the second end being located on the side of the rotational center of the rotation shaft member opposite to the first end of the rotor.

In addition, a stopper is provided in the chassis, which stopper suppresses vibrations of the rotor generated when a key is depressed. The third aspect of the invention provides a key device wherein the fulcrum of a key, the contact point of that key with a rotor, the rotational center of a rotation shaft member, the action point on that rotor of a key-returning spring, and the fastening point on the chassis of the key-returning spring are so disposed and arranged that the touch load of the key are practically the same at the start and end of a key stroke.

According to preferred embodiments of the invention, when a key is depressed with a finger, a frictional force operating in the same direction as the spring force acts between the after-fulcrum rear end portion of the key and the first end of the rotor and between the wall surfaces of the recessed portion of the rotor and the rotation shaft member, so that the touch load of the key increases, as indicated by curve X in FIG. 4.

Conversely, as the key is being returned to the original position, the frictional force operates in the direction opposite to that in which the spring force operates, so that the touch load of the key decreases, as indicated by curve Y in FIG. 4.

Thus, the static characteristics of each key are very similar to those in a piano, producing a hysteresis characteristic which enables each key to present a delicate, piano touch-like feel.

According to preferred embodiments of the invention, a heavy mass portion is provided on the second end of the rotor, which heavy mass portion turns with the rotor when it rotates about the rotation shaft member when the key is depressed. At this time, a large reaction force caused by the inertial mass of the heavy mass portion is felt on a finger depressing the key, this force being felt almost in the same way as is the reaction force caused by a hammer motion of the action mechanism of a piano at the time of striking a key. Accordingly, this dynamic characteristic of the key closely resembles that in a piano, as indicated by curve Z in FIG. 4. Additionally, a stopper is provided in the chassis, which stopper lowers to touch the chassis and suppress vibrations of the rotor when the key is depressed, so that vibrations of the rotor having a large inertial mass are suppressed. As a result, there is no abnormal touch felt by a finger depressing a key while the key and the rotor are always kept interlocked with each other for operation, so that there is obtained an operation very similar to the back check of a piano, which improves responsiveness of a key to successive striking thereof.

Further, according to preferred embodiments of the invention, the key touch load is approximately the same at the start and at the end of a key stroke. Therefore, static characteristics of a key are obtained which are very similar to those in a piano and no undue pressure is felt on fingers during a performance.

BRIEF DESCRIPTION OF THE DRAWINGS

The present invention will be explained in detail below with reference to the drawings, wherein.

DETAILED DESCRIPTION OF THE PREFERRED EMBODIMENTS

Figure 1:
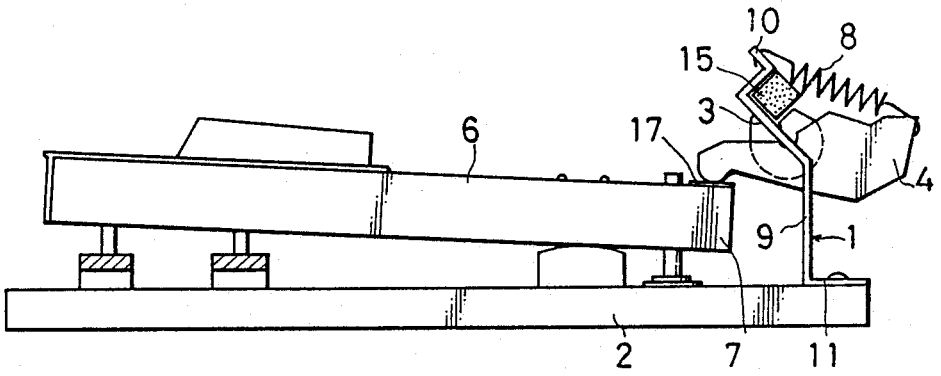
FIG. 1 is a side view of a preferred embodiment of the invention.
Figure 2:
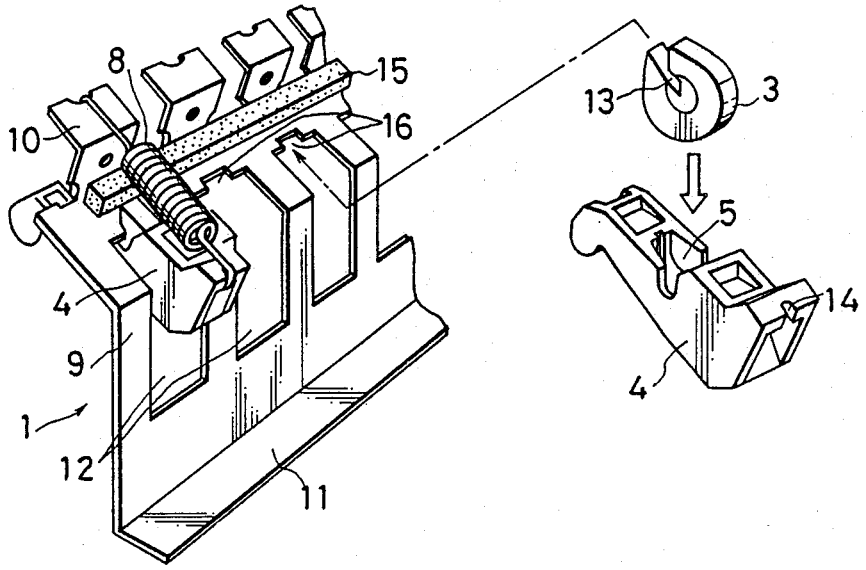
FIG. 2 is an exploded perspective view of important portions of the embodiment shown in FIG. 1.

FIGS. 1 and 2 show a preferred embodiment of the present invention. In accordance with this embodiment, a chassis 1 is fixed on a mount 2. A rotation shaft member 3 is fastened to the chassis 1 and a rotor 4 has a recessed portion 5 in which the rotation shaft member 3 fits so that the rotor 4 may be rotatable therearound. One end of the rotor 4 is put in contact with the upper surface of an after-fulcrum rear end 7 of a key 6 while there is a key-returning coil spring 8 set up to extend between the chassis 1 and the other end of the rotor 4, said other end being located on the other side of the rotational center of the rotation shaft member 3 in relation to said one end of the rotor 4.

As shown in FIG. 2, the chassis 1 comprises an angled upright portion 9, a spring bearing portion 10 and a fixing portion 11. The upright portion 9 is provided therein with a plurality of windows, each window being formed to receive therein a respective one of a plurality of rotors 4 corresponding to a plurality of keys 6. The rotation shaft member 3 has most of its periphery shaped like a round button and is provided with a groove 13 for fastening it to the chassis 1. The rotor 4 has a recessed portion 5 formed at its middle part for receiving the rotation shaft member therein. This recessed portion may be lubricated with a lubricant such as grease if necessary. One end of the rotor 4 is formed to have an arc-shaped surface so as to provide smooth contact with the upper surface of the after-fulcrum rear end 7 of the key 6, while the other end of the rotor has a groove 14 formed to have one end of the spring 8 fit therein so as to be coupled thereto. This other end is located on the side of the rotation shaft member opposite to said one end of the rotor.

In FIGS. 1 and 2, reference numeral 15 denotes a vibration absorber material made of, for example, sponge and attached to the chassis 1 to extend over a plurality of keys 6 so as to prevent vibrations of springs 8. Numeral 16 denotes a fastening portion formed to fit in the groove 13 of the respective rotation shaft member 3. Numeral 17 represents a Teflon tape or the like attached to after-fulcrum rear end 7 so as to facilitate smooth sliding of rotor 4.

In order to minimize an increase of key touch load in relation to a key stroke and thereby remove an undue pressure that may be felt by a finger during a performance so that the musical instrument can be played with more ease and smoothness, key 6, rotor 4 and coil spring 8 are arranged in a predetermined manner.

Figure 3:
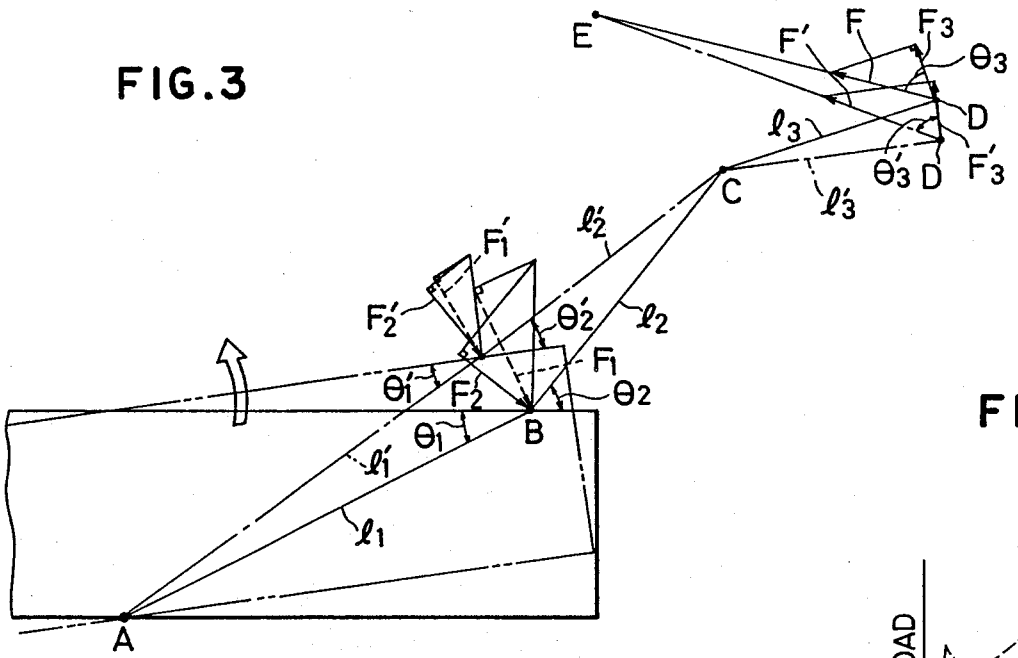
FIG. 3 is an operational diagram illustrating the operation of the embodiment shown in FIG. 1.

In FIG. 3, A represents the fulcrum of key 6, B represents the point of contact between rotor 4 and key 6, C represents the rotational center of rotor 4, D represents the action point on rotor 4 of coil spring 8, and E represents the fastening point on the chassis 1 of the coil spring 8.

A condition in which the touch load of a key does not increase is expressed as follows:

$$F_1 l_1 \geqq F_1' l_1' \tag{1}$$

where $F_1$ is the turning force derived from the drag applied by rotor 4 to key 6, $l_1$ is the distance between fulcrum A of key 6 and contact point B, and $F_1 l_1$ is the key turning moment at contact point B, all taken when the depressing finger is being released from the key; and $F_1'$, $l_1'$ and $F_1' l_1'$ are the same variables, except taken when the key is being depressed.

Strictly speaking, Eq. (1) should be $F_1 l_1 = F_1' l_1'$. However, taking into consideration the fact that there is actually some increase of the load due to a key switch not shown, the condition $F_1 l_1 > F_1' l_1'$ may also be included.

At the start of the stroke of key 6, moments about the rotational center of the rotor 4 are in equilibrium. Thus, $$F_2 l_2 = F_3 l_3 \tag{2}$$

$$F_3 = F \cdot \cos\theta_3 \tag{3}$$

where F is the restorative force of coil spring 8 at the time of release of the depressing finger from the key; $F_2$ is the turning force derived from the drag applied by key 6 to rotor 4 at the time of release of the depressing finger from the key; $F_3$ is the force turning rotor 4 derived from force F; $l_2$ is the distance between rotation center C of rotor 4 and contact point B at the time of release of the depressing finger from the key; $l_3$ is the distance between rotational center C of rotor 4 and action point D; and $\theta_3$ is the angle between F and $F_3$.

Since the vertical drag of rotor 4 and that of key 6 are equal, the following holds true:

$$\frac{F_1}{\cos\theta_1} = \frac{F_2}{\cos\theta_2} \tag{4}$$

where $\theta_1$ is the angle between a line drawn from fulcrum A to contact point B and the surface of key 6, and $\theta_2$ is the angle between a line drawn from contact point B to rotational center C and the surface of key 6, both at the time of release of the depressing finger from key 6.

From Eqs. (2)–(4), the following equation can be derived:

$$\begin{aligned} F_1 &= \frac{\cos\theta_1}{\cos\theta_2} \cdot F_2 \\ &= \frac{\cos\theta_1}{\cos\theta_2} \cdot \frac{l_3}{l_2} \cdot F \cdot \cos\theta_3 \end{aligned} \tag{5}$$

Equation (5) is equally applicable at the end of the stroke of key 6. Thus, $$F_1' = \frac{\cos\theta_1}{\cos\theta_2'} \cdot \frac{l_3'}{l_2'} \cdot F \cdot \cos\theta_3' \tag{6}$$

where $F_1'$, $F'$, $\eta_1'$, $\theta_2'$, $\theta_3'$, $l_2'$ and $l_3'$ are respectively forces, angles and distances corresponding respectively to $F_1$, $F$, $\theta_1$, $\theta_2$, $\theta_3$, $l_2$ and $l_3$, all at the time of depression of of key 6.

For practical purposes, the following relations can be applied to Eqs. (5) and (6):

$$l_2 \approx l_2',\ l_3 \approx l_3',\ F' > F,\ l_1 \approx l_1',$$

Therefore, in order for $F_1 = F_1'$ to be true, it is necessary that the following relationship be true;

$$\frac{\cos\theta_1}{\cos\theta_2} \cdot F \cdot \cos\theta_3 = \frac{\cos\theta_1'}{\cos\theta_2'} \cdot \cos\theta_3' \quad (7)$$

In other words, since $F' > F$, an increase of the key touch load can be minimized by having the fulcrum A of key 4, the contact point B, the rotational center C of rotor 4, the action point D of coil spring 8 and the fastening point E of coil spring 8 so arranged and disposed as to satisfy some of the following angular conditions: $\theta_1' \geqq \theta_1$, $\theta_2' \leqq \theta_2$, $\theta_3' \geqq \theta_3$.

Figure 4:
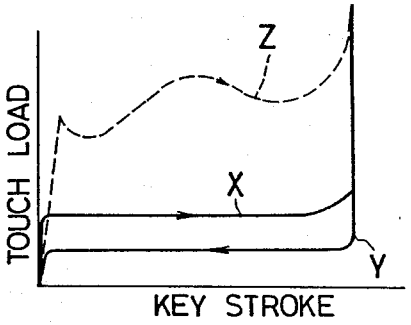
FIG. 4 is a diagram showing the key touch load versus key stroke characteristics of the embodiment shown in FIG. 1.

FIG. 4 is a diagram showing a key touch load versus key stroke characteristic in the preferred embodiment of the invention shown in FIGS. 1–3.

Figure 5:
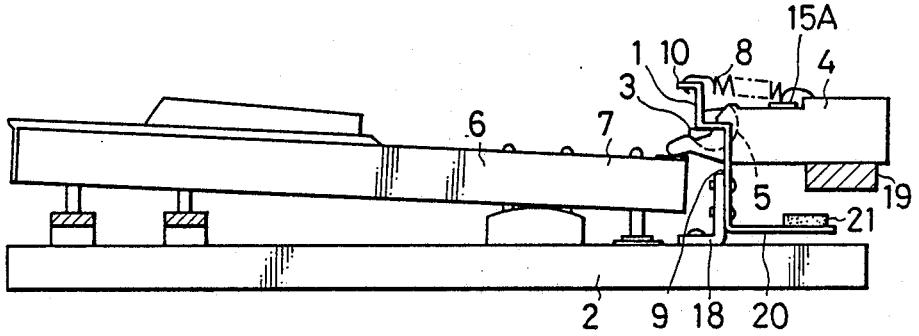
FIG. 5 is a side view of another preferred embodiment of the invention.
Figure 6:
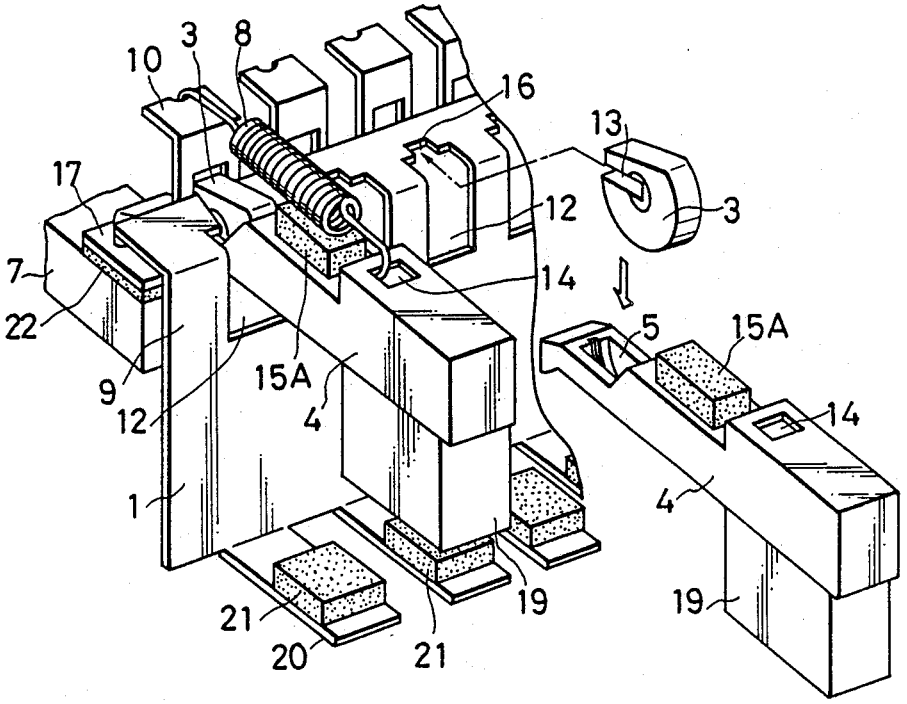
FIG. 6 is an exploded perspective view of important portions of the embodiment shown in FIG. 5.

FIGS. 5 and 6 show another preferred embodiment of the present invention, wherein a chassis 1 is fixed onto a mount 2 by a fixing member 18. A rotation shaft member 3 is fastened to chassis 1, as in the previously described embodiment of the invention. A rotor 4 is provided with a recessed portion 5 for receiving the rotation shaft member 3 so fit therein as to permit rotor 4 to be rotatable therearound, recessed portion 5 being lubricated with a lubricant such as grease when necessary.

The undersurface of one end of rotor 4 is arc-shaped so as to allow smooth contact with the upper surface of the after-fulcrum rear end 7 of the key 6, while the other end of rotor 4 has a weight 19 constituting a heavy mass portion attached to the undersurface thereof by an adhesive or the like, said other end being located on the side of rotational center C of rotor 4 opposite to said one end. On the upper surface of the middle portion of rotor 4 is arranged a vibration absorber material made of, for example, sponge and bonded thereto for the purpose of preventing vibrations of the key-returning coil spring 8.

The upright portion 9 of chassis 1 is provided at its lower end with a plurality of stopper members 20 spaced from mount 2 and extending laterally. Each stopper member is located below rotor 4. Each stopper member 20 has shock absorber material 21 such as felt or the like bonded to the upper surface thereof, these elements combining to form a stopper portion that absorbs the kinetic energy of rotor 4 when key 6 is depressed, thus suppressing vibrations thereof. The stopper portion also functions to control the rotational range of rotor 4 so that they may always be interlocked with each other for operation.

As clearly shown in FIG. 6, a Teflon tape 17 and a resilient material 22 located thereunder are bonded to the upper surface of the after-fulcrum rear end 7 of each key 6, said upper surface being where the undersurface of one end of rotor 4 comes into contact therewith, so that said one end of rotor 4 can slide smoothly thereon.

The key-returning coil spring 8 has one end fastened to groove 14 of rotor 4 and the other end fastened to the spring bearing portion 10 of chassis 1. Spring bearing portion 10 can be inclined so as to adjust the spring load.

In order to minimize an increase of the key touch load in relation to a key stroke and thereby eliminate any undue pressure that may be felt by a finger during a performance so that the musical instrument can be played with more ease and smoothness, key 6, rotor 4 and coil spring 8 are again arranged in a predetermined manner.

Figure 7:
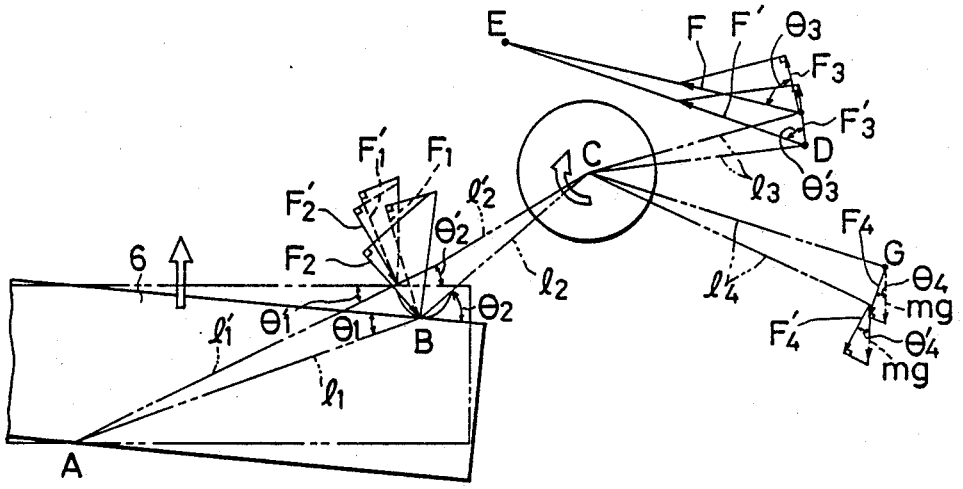
FIG. 7 is an operational diagram illustrating the operation of the embodiment shown in FIG. 5.

FIG. 7 is an operational diagram illustrating the operation of this second preferred embodiment of the invention. Points A, B, C, D and E shown in FIG. 7 are the same as those shown in FIG. 3. Point G is the center of gravity of a body of rotation comprising rotor 4 and weight 19.

The condition in which the touch load of key 6 does not increase is the same as in the first described embodiment, so that Eq. (1) also applies to the embodiment shown in FIGS. 5 and 6.

At the start of the stroke of key 6, moments about the rotational center C of rotor 4 are in equilibrium. Thus, $$F_2 l_2 = F_3 l_3 - F_4 l_4 \quad (8)$$

$$F_3 = F \cdot \cos\theta_3 \quad (9)$$

$$F_4 = mg \cdot \cos\theta_4 \quad (10)$$

where mg is the force of gravity at the center of gravity of a body of rotation comprising rotor 4 and weight 19; $l_4$ is the distance between rotational center C and center of gravity G; and $F_4$ is the force derived from gravity which turns rotor 4 at the time of release of the depressing finger from key. The other symbols are the same as those shown in FIG. 3. Since the vertical drag of rotor 4 and that of key 6 are equal, Eq. (4) also applies to the embodiment of FIGS. 5 and 6.

From Eqs. (4) and (8)–(10), the following equation can be derived:

$$\begin{aligned} F_1 &= \frac{\cos\theta_1}{\cos\theta_2} \cdot F_2 \\ &= \frac{(Fl_3 \cos\theta_3 - mgl_4 \cos\theta_4)}{l_2 \cdot \cos\theta_2} \cdot \cos\theta_1 \end{aligned} \quad (11)$$

Since Eq. (11) holds true even at the end of the stroke of key 6, the following equation holds true:

$$F_1 = \frac{(F' l_3' \cos\theta_3' - mgl_4' \cos\theta_4')}{l_2' \cos\theta_2'} \cdot \cos\theta_1' \quad (12)$$

For practical purposes, the following relations apply to Eqs. (11) and (12):

$$l_2 \approx l_2',\ l_3 \approx l_3',\ l_4 \approx l_4',\ l_1 \approx l_1'$$

Therefore, in order for $F_1 \approx F_1'$ to be true, it is necessary that the following relationship be true:

$$\frac{(Fl_3 \cos\theta_3 - mgl_4 \cos\theta_4)}{\cos\theta_2} \cdot \cos\theta_1 = \frac{(F' l_3' \cos\theta_3' - mgl_4' \cos\theta_4')}{\cos\theta_2'} \cdot \cos\theta_1' \quad (13)$$

Here, since $F' < F$, an increase of the key touch load can be minimized by having the fulcrum A of key 4, the contact point B, the rotational center C of rotor 4, the action point D of coil spring 8 and the fastening point E of coil spring 8 so arranged and disposed as to satisfy some of the following conditions: $\theta_1' \geqq \theta_1$, $\theta_2' \leqq \theta_2$, $\theta_3' \geqq \theta_3$, $\theta_4' \leqq \theta_4$.

Figure 8:
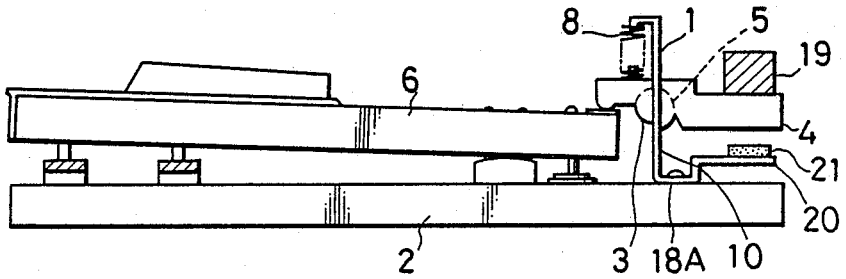
FIG. 8 is a side view of a variation of the embodiment shown in FIG. 5.
Figure 9:
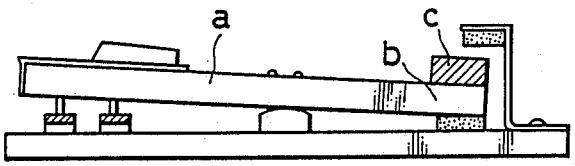
FIG. 9 PRIOR ART
FIGS. 9 and 10 are side views of prior art key devices.

FIG. 8 shows a third preferred embodiment of the invention, which is a variation of the embodiment shown in FIG. 5. In this embodiment, a fixing member 18A corresponding to fixing member 18 in FIG. 5 is formed integrally with chassis 1. The fastening portion of chassis 1 for receiving groove of rotation shaft member 3 therein is formed on the lower edge of the window, while the recessed portion 5 of rotor 4 for receiving rotation shaft member 3 therein is formed in the undersurface of the middle portion of rotor 4. The weight 19 serving as the heavy mass portion is attached to the upper surface of one end of rotor 4 while compression coil spring 8 is fastened to the upper surface of the other end of rotor 4. The other aspects of the arrangement and operation of this third embodiment are the same as shown in FIG. 5.

In the above-described embodiments, the key-returning spring consists of a coil spring 8 so that a high dimensional precision assuring the touch load of key 6 free of fluctuation is always realized. Therefore, such time and skill as required in the case of the conventional device using a U-shaped plate spring as shown in FIG. 10 are no longer necessary.

Figure 10:
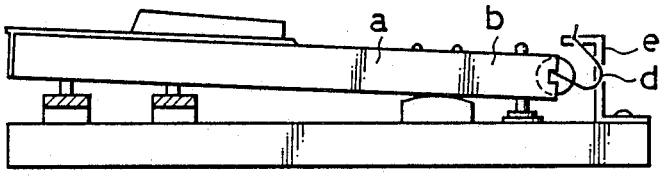
FIG. 10 PRIOR ART
Figure 11:
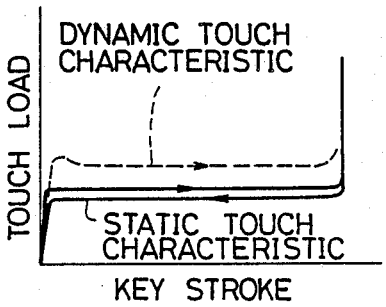
FIG. 11 is a diagram showing the key touch load versus key stroke characteristic of the prior art device shown in FIG. 10.

Further, in the case of the conventional device shown in FIG. 10, the restorative force of plate spring d always acts to push the supporting point thereof towards the fulcrum of key a, so that the supporting point portion becomes shaky, resulting in positional change of the supporting point over time. In the above-described third embodiment of the invention, however, the spring force of coil spring 8 acts in the rotational direction of rotor 4, so that the aforementioned disadvantage of the conventional device is absent.

Arranged as described in the foregoing, the invention has numerous advantageous effects.

In particular, the static characteristics of each key make a hysteresis characteristic which is instrumental to achieving a delicate, piano-touch expression in a performance.

In addition, the dynamic touch characteristic of each key is very similar to that in a piano due to the large equivalent mass of the key, this providing a sure reactive force felt in response to every striking of a key.

Furthermore, the invention provides the advantage that the stopper portion thereof prevents any abnormal touch from being felt by a finger depressing a key and further improves the responsiveness to successive strikings of a key.

Finally, the static touch characteristics of each key are very similar to those in a piano due to the small increase in key touch load when a key is depressed. Therefore no undue pressure is felt by a finger during a performance.

What is claimed is:

1. In a key device for an electronic keyboard musical instrument having a key mounted rotatably on a fulcrum member mounted on a support, a rotor provided with a recessed portion into which a rotary shaft member is fitted, said rotor rotating with respect to said rotary shaft member, and a key-returning coil spring serving to put one end of said rotor in contact under pressure with an after-fulcrum end of said key, the improvement wherein said rotor has a heavy mass portion attached at the other end thereof and located beyond the rotation center of said rotary shaft member from said one end, wherein a chassis is mounted on said support and is provided with said rotary shaft member and a stopper means designed to suppress vibrations of said rotor generated when said key is depressed, wherein said rotor is attached to said rotary shaft member, wherein one end of said coil spring is fastened to said chassis, the other end of said coil spring being fastened to said rotor, and wherein a contact point of said fulcrum and said key, a contact point of said key and said rotor, said rotation center of said rotary shaft member, a point at which said key-returning coil spring acts on said rotor, a point at which said key-returning coil spring is fastened to said chassis, and a center of gravity for said heavy mass portion are all arranged so as to provide a condition in which the key touch load remains substantially unchanged between the beginning and the end of the key stroke.

* * * * *